US008156993B2

(12) United States Patent
Kao

(10) Patent No.: US 8,156,993 B2
(45) Date of Patent: Apr. 17, 2012

(54) ROLL SCREEN CONTROL MEMBER

(75) Inventor: Yu-Ting Kao, Sinshih Township, Tainan County (TW)

(73) Assignee: Uni-Soleil Ent. Co., Ltd., Tainan County (TW)

( * ) Notice: Subject to any disclaimer, the term of this patent is extended or adjusted under 35 U.S.C. 154(b) by 138 days.

(21) Appl. No.: 12/588,945

(22) Filed: Nov. 3, 2009

(65) Prior Publication Data

US 2011/0100568 A1 May 5, 2011

(51) Int. Cl.
*E06B 9/20* (2006.01)

(52) U.S. Cl. ..... 160/321; 160/323.1

(58) Field of Classification Search ..... 160/321, 160/323.1, 307
See application file for complete search history.

(56) References Cited

U.S. PATENT DOCUMENTS

| | | | | |
|---|---|---|---|---|
| 5,975,186 | A * | 11/1999 | Day | 160/321 |
| 6,158,563 | A * | 12/2000 | Welfonder et al. | 192/223.3 |
| 6,173,825 | B1 * | 1/2001 | Liu | 192/223.4 |
| 7,497,242 | B2 * | 3/2009 | Wang | 160/321 |
| 7,677,293 | B2 * | 3/2010 | Allsopp | 160/323.1 |
| 2003/0085003 | A1 * | 5/2003 | Cheng | 160/321 |

* cited by examiner

*Primary Examiner* — Blair M. Johnson
(74) *Attorney, Agent, or Firm* — Rosenberg, Klein & Lee

(57) ABSTRACT

A roll screen control member is revealed. The roll screen control member consists of a sprocket wheel, a chain protection cover, a sprocket support, a cover spring, a splined bush and a central pin. The splined bush is mounted with a roll screen tube while the central pin includes a central pin head with a plurality of cutting surfaces. After the central pin being locked into the sprocket support, each cutting surface of the central pin is corresponding to each cutting surface on the sprocket support. When a chain is pulled, due to the precise locking between the central pin and the sprocket support, splined bush is moved along with the cover spring so as to drive the roll screen tube to rotate along with the movement and further control extension or retraction of the roll screen.

2 Claims, 7 Drawing Sheets

ROLL SCREEN CONTROL MEMBER

BACKGROUND OF THE INVENTION

1. Fields of the Invention

The present invention relates to a roll screen control member, especially to a roll screen control member with a novel design that drives a roll screen tube to rotate precisely and further controls an extended or retracted state of a screen of the roll screen.

2. Descriptions of Related Art

The roll screen control member available now is composed of a sprocket wheel, a chain protection cover, a sprocket support, a cover spring, a splined bush and a central pin. The splined bush is mounted with a roll screen tube while the central pin includes a central pin head with a single cutting surface corresponding to a cutting surface on an inner wall of the sprocket support. After the central pin being locked into the sprocket support, they are locked and fixed with each other by matching and corresponding of the cutting surface of the central pin head with the cutting surface on the inner wall of the sprocket support.

However, in practice, such locking and fixing way by means of only a single cutting surface raises a problem. When the chain moves so as to make the cover spring drive the splined bush rotating the roll screen tube, a spin or slide occurs once a transmission torque exerted is too large and the fixing between the central pin and the sprocket support is not so securely. Especially when the size of the roll screen is getting larger, its transmission torque increases and the condition becomes more obvious.

Refer to U.S. Pat. No. 7,100,668, at least one fins is disposed on a center-pin head of a center pin while at least one recess is mounted in a sprocket support that is inserted by the center-pin head. The fin of the center pin is adapted to cooperatively engage with the recess in the sprocket support. The problem of spin or slide caused by unsecured fixing between the central pin and the sprocket support can be solved by the engagement between the fin and the recess.

A roll screen control member of the present invention can also prevent the spin or slide caused by unsecured fixing between the central pin and the sprocket support.

SUMMARY OF THE INVENTION

Therefore it is a primary object of the present invention to provide a roll screen control member that makes a chain precisely drive a roll screen tube to rotate while the chain of the roll screen being pulled so that a screen of the roll screen can be extended or retracted smoothly.

In order to achieve above object, a roll screen control member of the present invention includes a sprocket wheel, a chain protection cover, a sprocket support, a cover spring, a splined bush and a central pin. The splined bush is mounted with a roll screen tube while the central pin includes a central pin head with a plurality of cutting surfaces. After the central pin being locked into the sprocket support, each cutting surface of the central pin matches and corresponds to each of a plurality of cutting surfaces of the sprocket support. Thereby while pulling the chain, due to precise matching and locking of the plurality of cutting surfaces of the central pin precisely with the plurality of cutting surfaces of the sprocket support, the chain drives the roll screen tube to rotate along with its movement through the sprocket wheel, the cover spring and the splined bush so as to control extension or retraction of the screen of the roll screen.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein:

FIG. 2 1 is an explosive view of partial components of an embodiment according to the present invention;

FIG. 5 1 is an explosive view of partial components of another embodiment according to the present invention;

DETAILED DESCRIPTION OF THE PREFERRED EMBODIMENT

Figure 1:
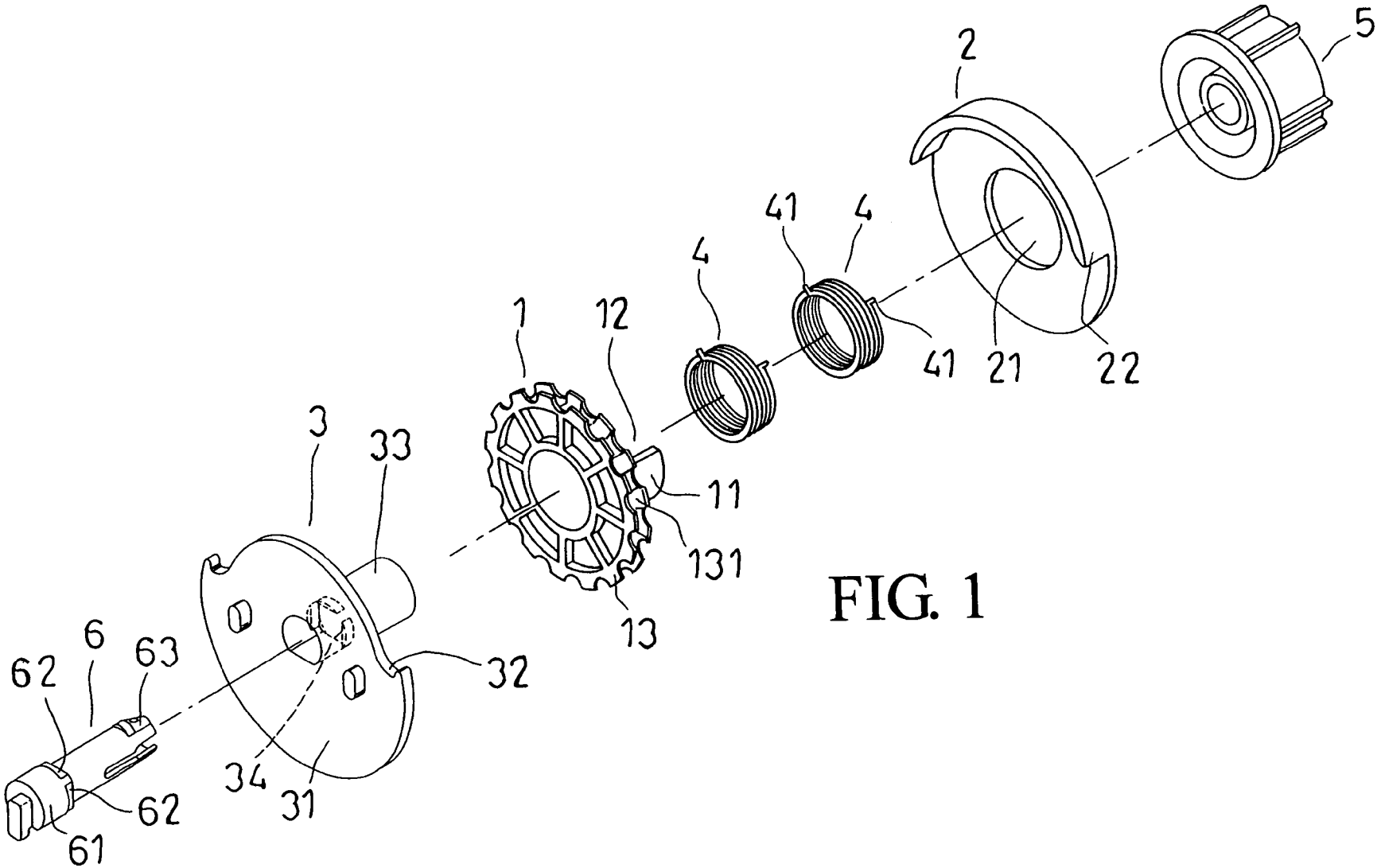
FIG. 1 is an explosive view of an embodiment of a roll screen control member according to the present invention.
Figure 2:
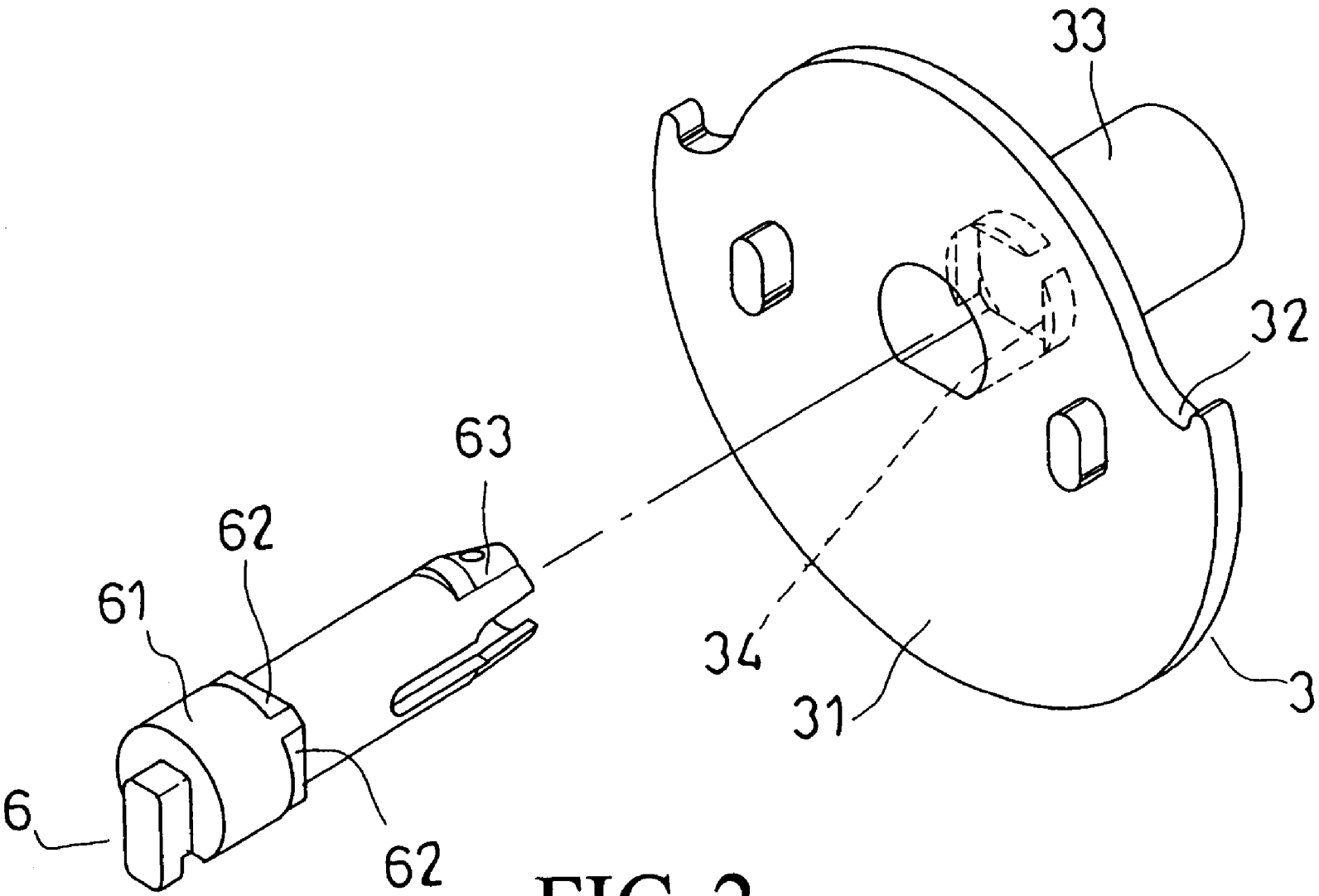
Figure 3:
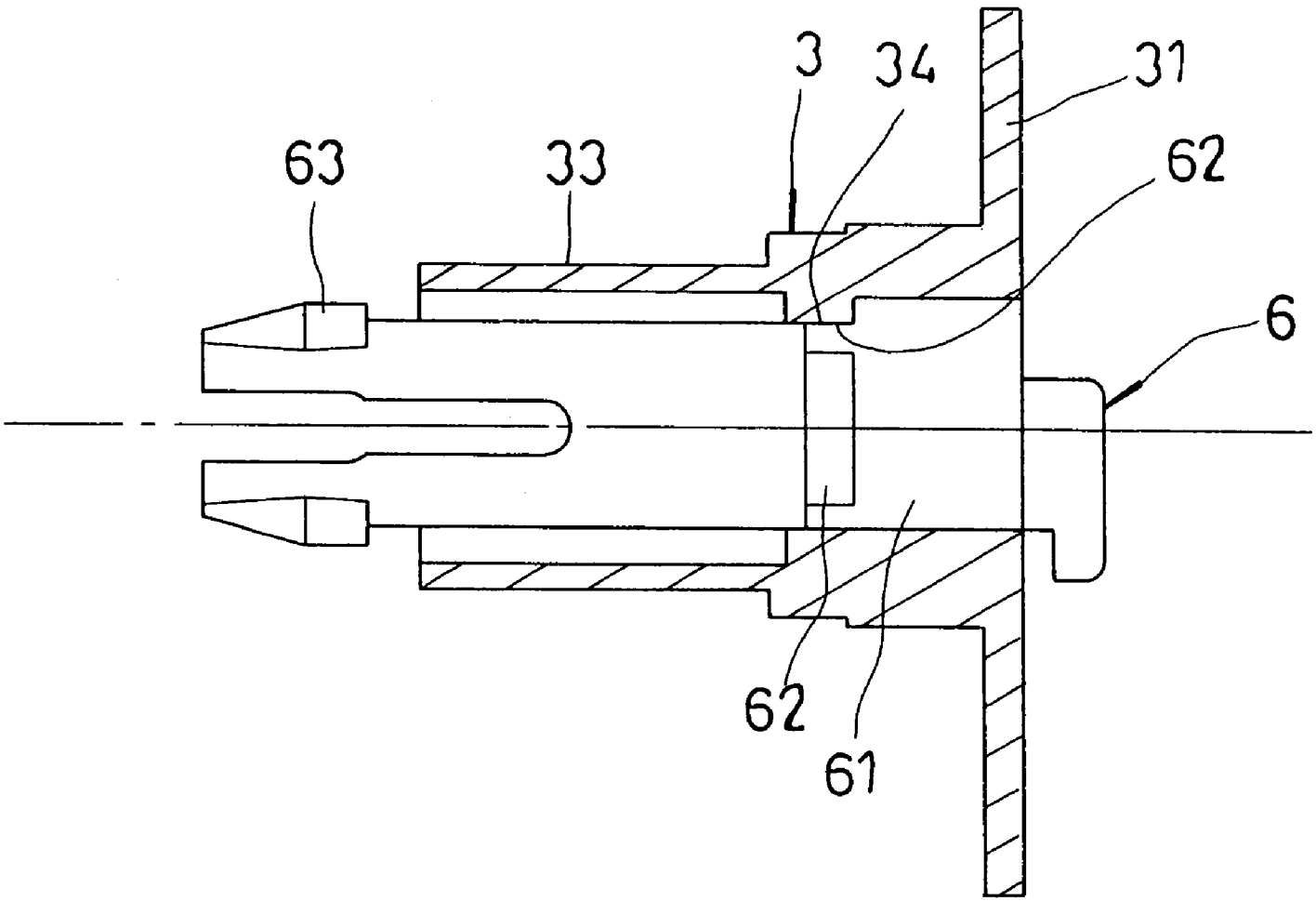
FIG. 3 is a lateral cross sectional view of partial components of an embodiment according to the present invention.
Figure 4:
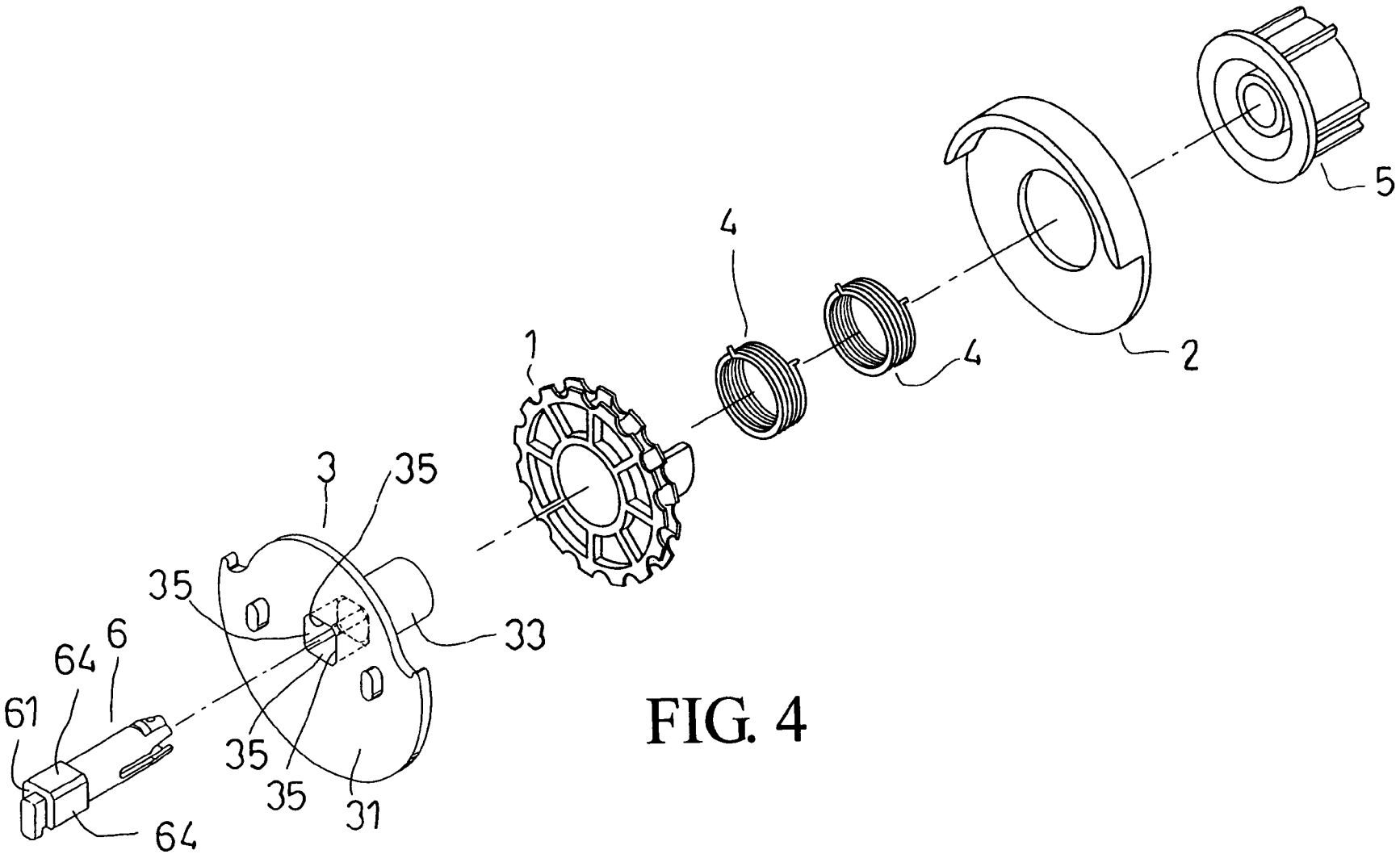
FIG. 4 is an explosive view of another embodiment of a roll screen control member according to the present invention.
Figure 5:
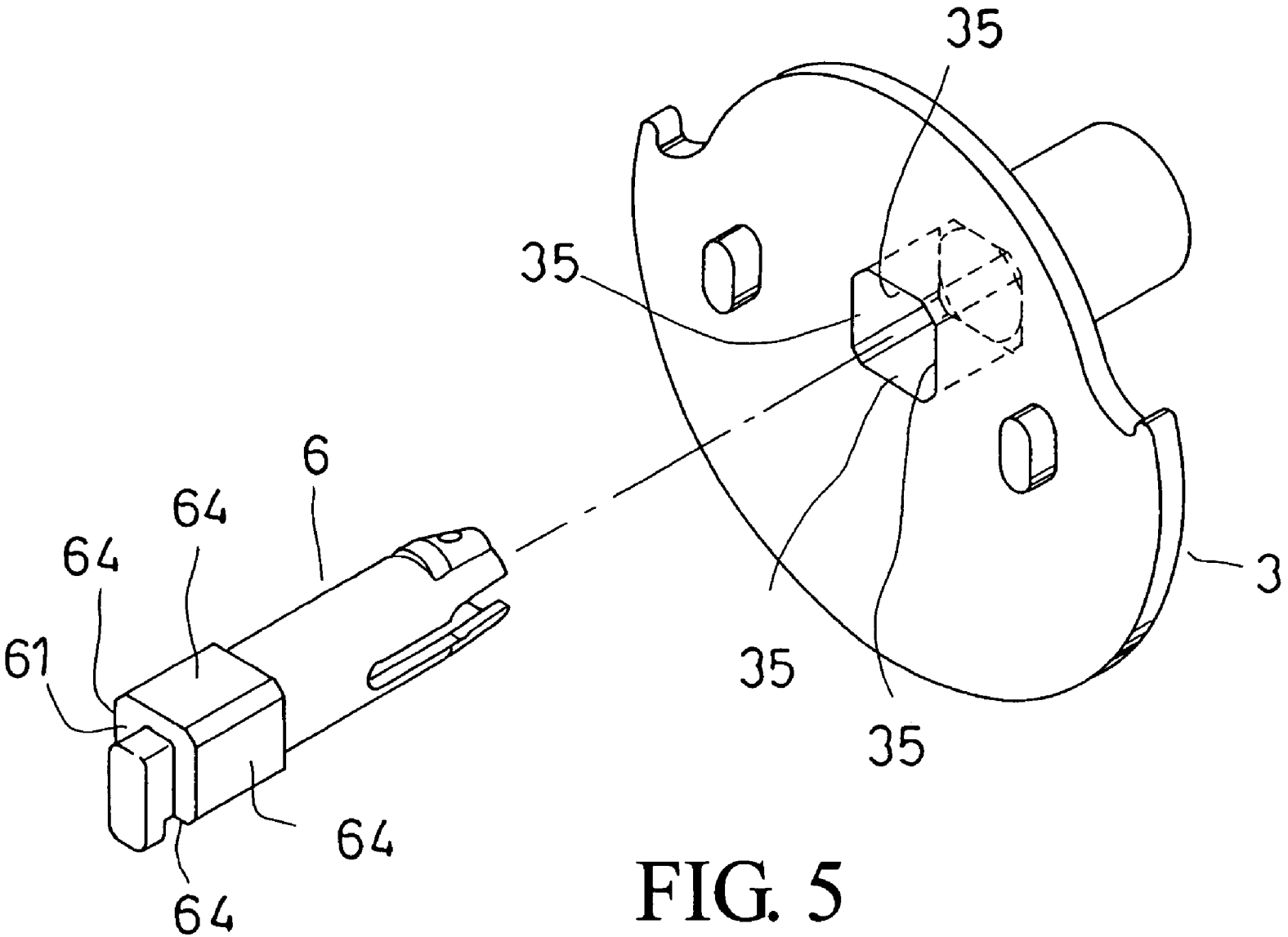
Figure 6:
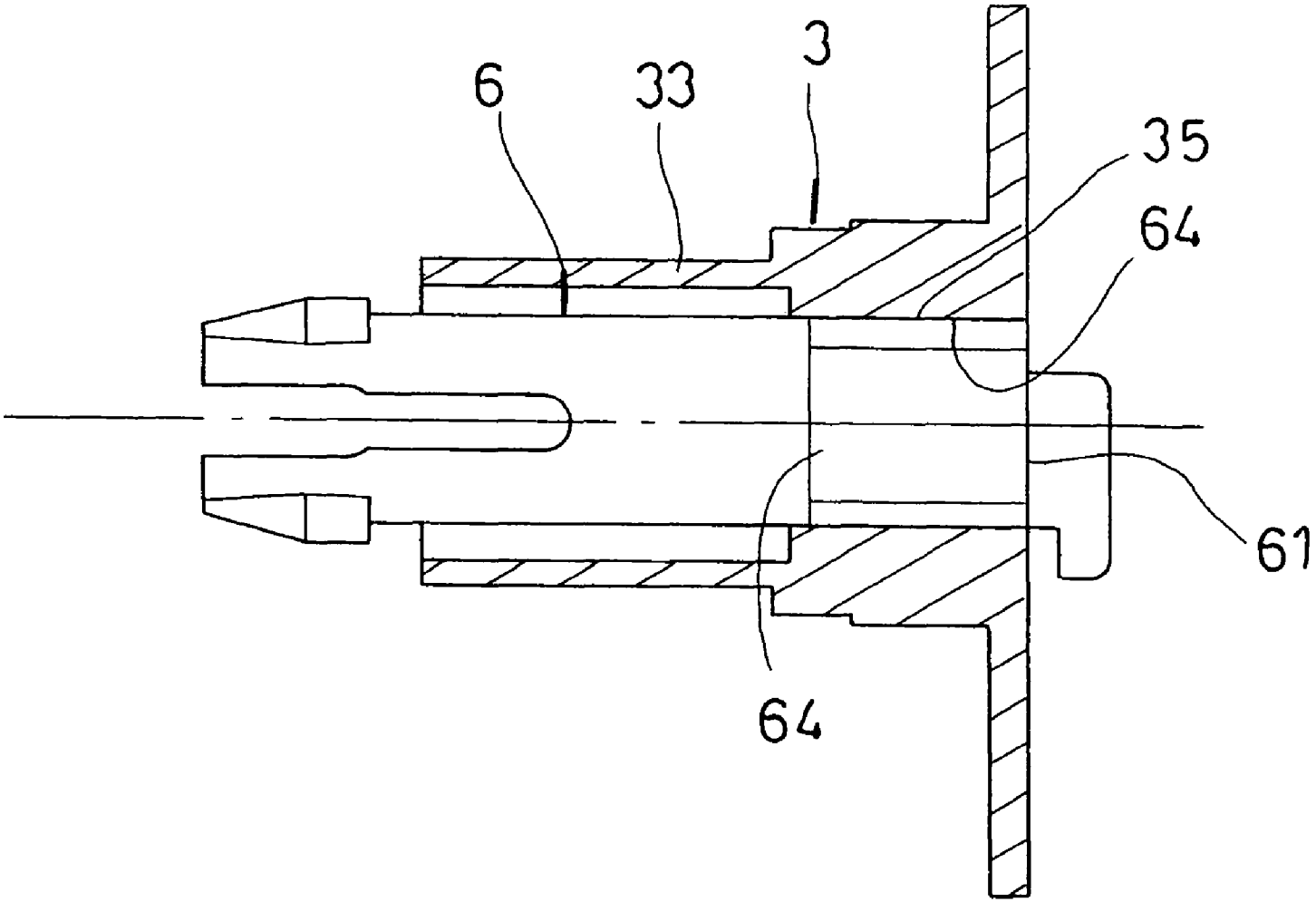
FIG. 6 is a lateral cross sectional view of partial components of another embodiment according to the present invention.
Figure 7:
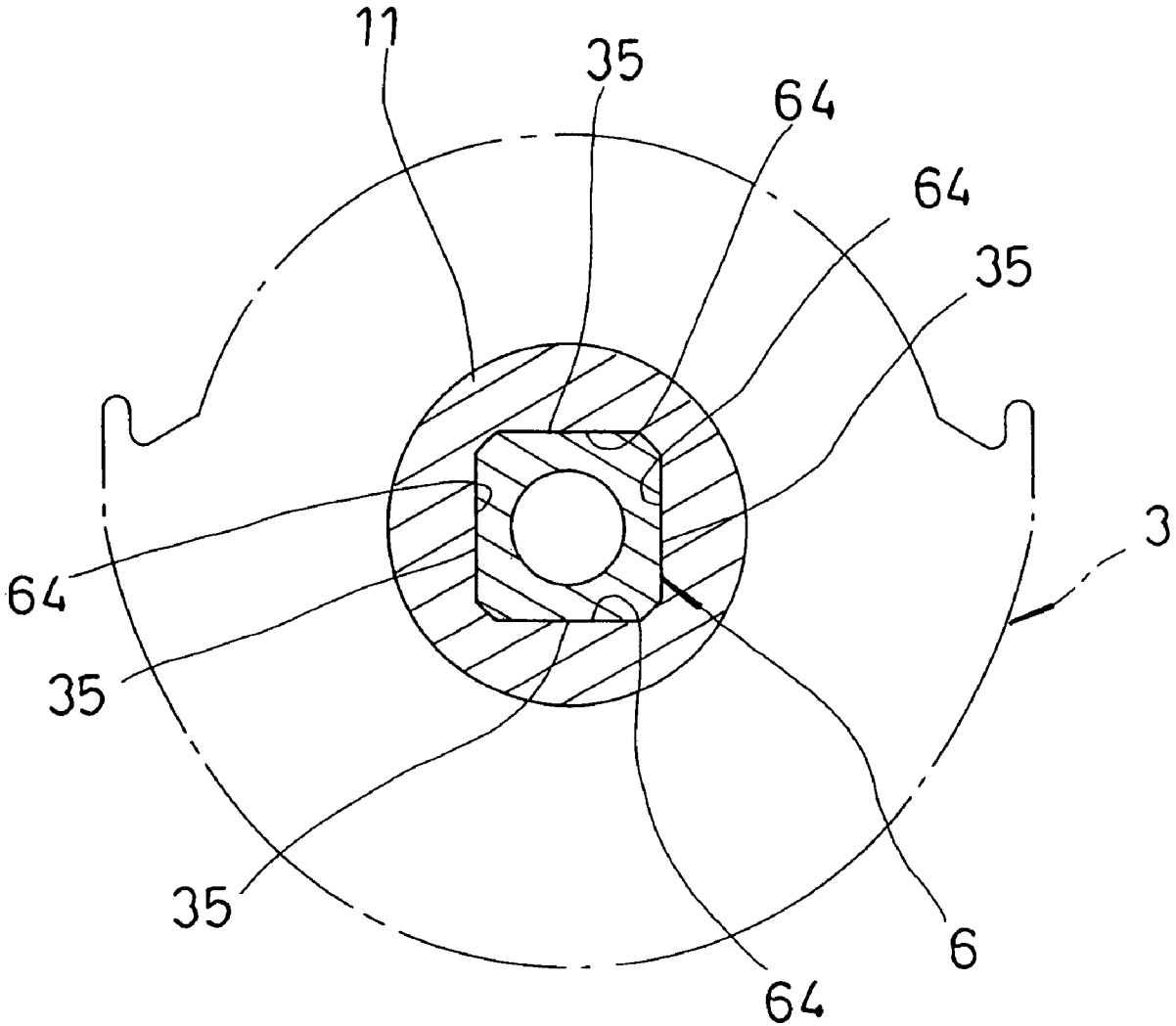
FIG. 7 is a front view showing partial components in the assembled state of another embodiment according to the present invention.

Refer from FIG. 1 to FIG. 3, a roll screen control member of the present invention consists of a sprocket wheel 1, a chain protection cover 2, a sprocket support 3, at least one cover spring 4, a splined bush 5 and a central pin 6.

The sprocket wheel 1 includes a shaft penetration part 11 on the center thereof, an open gap 12 formed over the shaft penetration part 11, a circular sprocket 13 on one end of the shaft penetration part 11 and a ball receiving slot 131 for accommodating balls of a ball chain (not shown in figure) arranged around the circular sprocket 13.

The chain protection cover 2 consists of an insertion hole 21 arranged at the center thereof and inserted by the shaft penetration part 11 of the sprocket wheel 1, a shield part 22 extended from top of an upper circle for covering the ball chain disposed on the circular sprocket 13 of the sprocket wheel 1.

The sprocket support 3 is composed of a plate body 31 whose circumference is with a limiting part 32 corresponding to the shield part 22 of the chain protection cover 2, a hollow sleeve part 33 corresponding to the chain protection cover 2 disposed projectingly on the plate body 31 and inserting through the shaft penetration part 11 of the sprocket wheel 1, and at least three projecting locking parts 34 whose surface are cutting surfaces arranged projectingly at an inner wall (a wall of an inner hole) of the sleeve part 33.

The cover spring 4 is disposed around the sleeve part 33 of the sprocket support 3 and is having a projecting section 41, corresponding to the open gap 12 of the shaft penetration part 11 of the sprocket wheel 1, on each of two ends thereof.

The splined bush 5 is directly covered on and assembled with the shaft penetration part 11 of the sprocket wheel 1 and is mounted with a roll screen tube.

The central pin 6 includes a central pin head 61 on one end thereof, at least three flat cutting surfaces 62 on the central pin head 61, and a locking part 63 on the other end thereof. The flat cutting surfaces 62 are corresponding to the cutting surfaces of the projecting locking parts 34 arranged projectingly at the inner wall of the sleeve part 33 of the sprocket support 3. Thus after the central pin 6 inserting into and locked by the sprocket support 3, the flat cutting surfaces 62 matches the projecting locking parts 34 of the sprocket support 3 closely. As to the locking part 63, it locks with a shaft flange of the splined bush 5.

Thereby, each flat cutting surface 62 of the central pin 6 precisely assembles and locks with corresponding projecting locking part 34 of the sprocket support 3 while pulling a chain. Thus through the sprocket wheel 1, the cover spring 4 and the splined bush 5, the chain drives the roll screen tube to rotate along with its movement so as to control extension or retraction of a curtain of the roll screen.

Due to at least three flat cutting surfaces 62 disposed on the central pin head 61 of the central pin 6 corresponding to each of the cutting surfaces of the projecting locking parts 34 arranged projectingly at the inner wall of the sleeve part 33 of the sprocket support 3, the central pin 6 and the sprocket support 3 are precisely locked with each other so that the roll screen tube assembled with the splined bush 5 is driven by the cover spring 4 to rotate along with the movement of the sprocket wheel 1 driven by the chain being pulled. Thus the curtain of the roll screen is controlled to be retracted upward or extended downward. Moreover, a spin/slide between the central pin 6 and the sprocket support 3 caused by too much torque can be avoided.

Furthermore, refer from FIG. 4 to FIG. 7, another embodiment is revealed. There are four cutting surfaces 64 disposed on the central pin head 61 of the central pin 6 while the inner wall of the sleeve part 33 of the sprocket support 3 is formed by four cutting surfaces 35 connected with one another and corresponding to the cutting surfaces 64. After the central pin 6 being inserted into and locked with the sprocket support 3, the cutting surfaces 64 of the central pin 6 matches and corresponds to the cutting surfaces 35 of the sprocket support 3 property so as to ensure the assembly and fixing therebetween and avoid the spin/slide.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A roll screen control member comprising:

a sprocket wheel, a chain protection cover arranged at one side of the sprocket wheel, a sprocket support having a plurality of projecting locking parts whose surfaces project inwardly from a longitudinally extending inner wall of a hole extending therethrough while the sprocket support is inserted through the other end of the sprocket wheel, the surfaces being spaced from opposite ends of said longitudinally extending inner wall, at least one cover spring disposed around one end of the sprocket support that inserts through the sprocket wheel, a splined bush engaged with a roll screen tube, and a central pin including a central pin head with a plurality of flat cut surfaces only at one end thereof and each cut surface matching and corresponding to and matingly engaged with the corresponding projecting locking parts of the sprocket support after the central pin is locked into the sprocket support while a rear end of the central pin is assembled with the splined bush.

2. The device as claimed in claim 1, wherein a number of the projecting locking parts on the wall of the inner hole of the sprocket support and a number of the cutting surfaces on the central pin head of the central pin are both three.

* * * * *